United States Patent [19]

Thielen

[11] 4,225,998

[45] Oct. 7, 1980

[54] DUST MOP FRAME

[75] Inventor: James E. Thielen, New Brighton, Minn.

[73] Assignee: Minnesota Mining and Manufacturing Company, Saint Paul, Minn.

[21] Appl. No.: 22,312

[22] Filed: Mar. 20, 1979

[51] Int. Cl.[3] ..... A47L 13/256; A47L 13/29

[52] U.S. Cl. ..... 15/231; 51/385

[58] Field of Search ..... 15/231, 232, 233; 51/382, 384, 385–388

[56] References Cited

U.S. PATENT DOCUMENTS

| | | | |
|---|---|---|---|
| 1,855,635 | 4/1932 | Kelley | 15/231 X |
| 1,991,693 | 2/1935 | Oberti | 15/231 |
| 2,242,545 | 5/1941 | Randolph | 51/386 X |
| 2,438,338 | 3/1948 | Horn | 15/231 X |
| 2,530,301 | 11/1950 | Hoy | 51/385 X |
| 3,099,855 | 2/1962 | Nash . | |
| 3,267,622 | 8/1966 | Frostad | 15/231 X |
| 3,430,284 | 7/1967 | Fuerst . | |

FOREIGN PATENT DOCUMENTS

| | | | |
|---|---|---|---|
| 2646685 | 4/1977 | Fed. Rep. of Germany . | |
| 1012476 | 7/1952 | France | 51/384 |
| 359058 | 5/1938 | Italy | 15/231 |

*Primary Examiner*—Edward L. Roberts

*Attorney, Agent, or Firm*—Cruzan Alexander; Donald M. Sell; Richard Francis

[57] ABSTRACT

A dust mop frame suited for holding a dusting fabric with a central portion of the fabric extending across the bottom surface of the frame and over opposite edge portions and extending to the top surface includes a plurality of toggle assemblies for retaining the edge portions of the fabric on the top surface. The toggle assemblies are arranged in opposed sets of at least one toggle assembly adjacent each edge portion of the frame. The toggle assemblies comprise a toggle member having a pivot axis, an arm portion projecting generally radially from the axis, a lip portion spaced from an axis projecting from one side of the arm portion and extending parallel to the axis, a curved portion having an arcuate surface disposed around the pivot axis, means mounting the toggle member on the frame for pivotal movement around the axis, a spring mounted on the frame adapted to frictionally engage and slide along the arcuate surface upon movement of the toggle member.

8 Claims, 3 Drawing Figures

DUST MOP FRAME

BACKGROUND OF THE INVENTION

1. Field of the Invention

This invention relates to a novel dust mop frame of the type adapted to receive a dusting fabric with a central portion of the fabric extending across the bottom surface and opposite edge portions of the frame and onto the top surface.

2. Background of the Prior Art

Dust removal from smooth hard surfaces such as floors is a continuing problem for both the homemaker and the professional building maintenance personnel. Such removal is generally accomplished by wiping the surface with a cleaning element such as a fabric which may be held in a frame. Early dust mop cleaning elements were made of fibers such as cotton which may be treated with an impregnant such as oil to give the fibers a higher capacity for collecting dust. Woven and nonwoven fabrics have also been employed for this purpose, as well as collections of loose fibers. Nonwoven fabrics are preferred because they are relatively inexpensive to produce. Dust collecting elements formed of nonwoven fabrics are generally called "disposable" because they are discarded instead of being cleaned and reused.

Many types of dust mop frames for holding nonwoven disposable dusting fabrics are known. Such frames are characterized by including a pad portion, which is typically rectangular, over which is deployed the dusting fabric so that it covers the pad face and extends at least over the leading edge of the pad and is typically fastened on top with suitable fastening means. The frame also typically includes a handle holder into which a suitable handle may be fitted. Such known dust mop frames have certain deficiencies, however.

German Offenlegungsschrift 26 46 685 discloses a dust mop frame which has opposed hinged elements having a contact surface opposite the hinge which is adapted to frictionally engage the wall of a channel into which the edges of a dusting fabric are placed. The contacting surface severely impinges upon the surface of the dusting fabric, weakening the fabric at the contact line. This results in premature failure of the fabric thereby reducing its effective use life.

Nash (U.S. Pat. No. 3,099,855) discloses a mop frame having opposed sets of openings into which portions of fabric edges are forced. These openings include holding means comprising a plurality of slits which extend radially from a common center thereby forming triangular segments about the common center, into which cleaning fabric may be pressed to cause yielding of the triangular shapes and opening of the spaces therebetween to permit entry of the fabric. Release of the pressure causes the plates to attempt to resume the original position thereby grasping the fabric. While such an arrangement may provide for firm holding of the fabric, removal of the fabric to reverse it to use its opposite side is difficult because removal almost always results in destruction of the fabric since there is no convenient way of releasing the grasping force. Torn segments of fabric would also be retained in the grasping means, requiring removal before a new fabric could be inserted.

Fuerst (U.S. Pat. No. 3,430,284) discloses a mop frame which includes opposed openings on the top surface for receiving portions of the edges of a dusting fabric and a strip of steel having a free end which extends into the opening and is biased by its own resiliency into contact with a seat therein. Contact between the end of the steel strip and the seat with the fabric therebetween provides for holding of the fabric in place. Such an arrangement does not always provide for the smooth holding of the fabric and could cause tearing of the typically more fragile nonwoven fabric.

SUMMARY OF THE PRESENT INVENTION

The dust mop frame of the present invention provides for the smooth holding without damage of a nonwoven dusting fabric on the surface of the frame and on the side edges by means of a plurality of toggle assemblies fastened to the top surface of the mop frame. The toggle assemblies engage the portions of the edge of a dusting fabric without the application of a sharp edge thereby reducing the tendency of the fabric to tear and also easily releasing the fabric without damage to permit the fabric to be reversed and used on the opposite surface.

The dust mop frame of the present invention is characterized by having opposite top and bottom surfaces and being adapted to receive a dusting fabric with a central portion of the fabric extending across the bottom surface and opposite edge portions of the frame and extending onto its top surface. The frame includes a means for restraining the edge portions of the fabric on the top surface comprising a plurality of toggle assemblies. Each of the toggle assemblies is disposed in opposed sets with at least one toggle assembly adjacent each of the edge portions of the frame.

Each toggle assembly comprises a toggle member having a pivot axis, an arm portion projecting generally radially from the axis, a lip portion spaced from the axis, projecting from one side of the arm portion and extending parallel to the axis, a curved portion having an arcuate surface disposed around the pivot axis, means mounting the toggle member on the frame for positionable pivotal movement around the axis between a release position with the lip spaced from the top surface of the frame to afford insertion of the edge portion of the dusting fabric therebetween, and an engage position with the lip pressing the edge portion of the dusting fabric therebetween against the top surface of the frame. A spring is mounted on the frame having a portion adapted to frictionally engage and slide along the arcuate surface upon movement of the toggle member between the release and engage positions. The adjacent surfaces of the frame and the lip are shaped to hold the edge portion of the fabric therebetween when the toggle member is in the engage position thereby to restrict the withdrawal of the fabric.

Preferably the dust mop frame has an elongate shape having spired ends and includes opposed sets of the toggle assemblies adjacent each of the ends. A preferred dust mop frame includes a handle portion associated with each of the toggle members extending parallel to the pivot axis and projecting from the side of the pivot arm opposite the lip portion and a terminal end portion projecting past the edge of the frame when the toggle member is in the engage position.

Preferably, the arcuate surface of the toggle member is disposed eccentrically around the pivot axis to provide a first portion of the arcuate surface spaced a first distance from the axis and a second portion spaced a second distance from the axis which is less than the first distance. In such an embodiment, the spring portion bears to a greater extent against the first portion of the arcuate surface when the toggle member is in its engage position and to a lesser extent against the second portion of the arcuate surface when the toggle member is in its release position. A preferred embodiment also includes openings recessed from the top surface of the frame and adapted to receive the lips of the toggle assemblies when the toggle members are in their engage position.

DRAWING

The invention is further illustrated by reference to the drawing wherein the same reference numeral in the various figures refers to the same element and wherein.

DETAILED DESCRIPTION OF THE PREFERRED EMBODIMENTS

Figure 1:
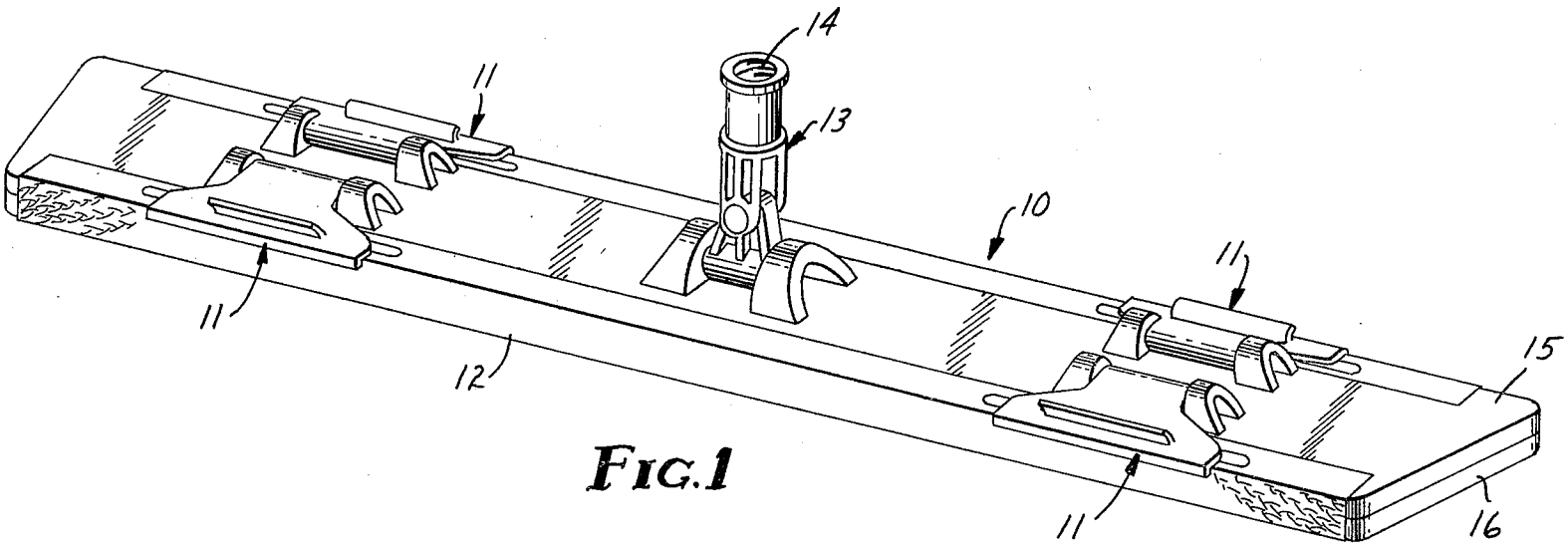
FIG. 1 is a perspective view of the dust mop frame of the present invention, with a dusting fabric mounted therein.
Figure 2:
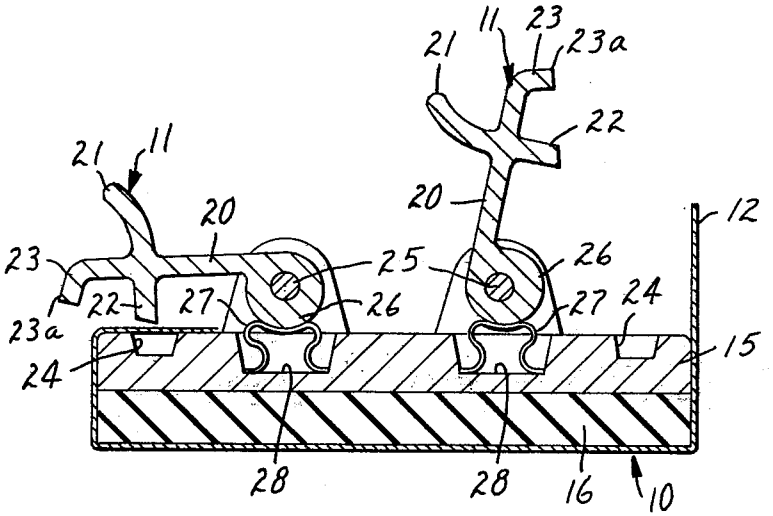
FIG. 2 is an enlarged cross sectional view of the dust mop frame taken on line 2—2 of FIG. 1, except both of the toggle members are shown in a release position with one of the pivot arms extending upward and the other in an open position permitting release of the dusting fabric.
Figure 3:
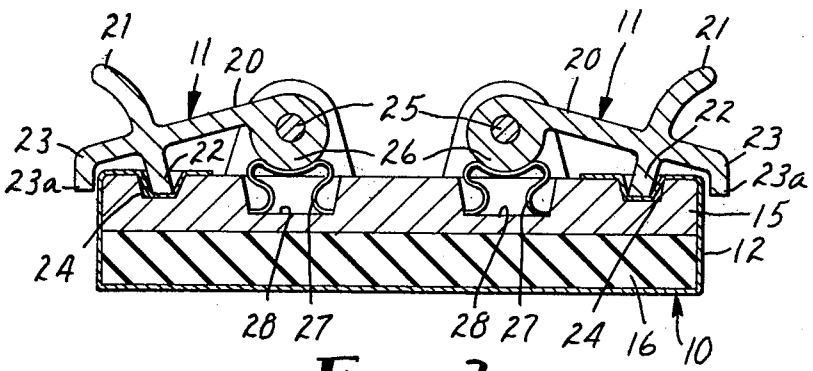
FIG. 3 is an enlarged cross sectional view of the dust mop frame taken on line 2—2 of FIG. 1.

The general nature of the dust mop frame of the present invention will be apparent from a consideration of the following description read when in view of the accompanying drawing. In FIGS. 1-3, there is illustrated a preferred embodiment of the invention showing a dust mop frame 10 characterized by the opposite top and bottom surfaces and being adapted to receive a piece of dusting fabric 12 with a central portion of the fabric extending across the bottom surface and the opposite edge portions of the frame 10, extending onto the top surface. A plurality of toggle assemblies 11 mounted on the top surface of the dust mop frame in opposed sets with at least one toggle assembly adjacent each of the edge portions of frame 10 provides a means for retaining the edge portions of fabric 12 on the top surface of the mop frame.

Each toggle assembly 11 comprises a toggle member having a pivot axis 25, an arm portion 20 projecting generally radially from the axis 25, a lip portion 22 extending parallel to axis 25, a curved portion 26 having an arcuate surface disposed around pivot axis 25.

The toggle assembly 11 includes means for mounting the toggle member on the top surface of frame 10 for pivotal movement around axis 25 between a release position with lip 22 spaced from the top surface of frame 10 (as shown in FIG. 2) to afford insertion of the edge portion of fabric 12 therebetween and an engage position shown in FIG. 3 with lip 22 pressing the edge portion of fabric 12 therebetween against the top surface of frame 10. Means for mounting the embodiment shown in FIGS. 1-3 may be formed by casting the appropriate mounting assembly as an integral part of the top surface backing plate 15 which forms the top part of frame 10.

A spring 27 mounted on frame 10 has a portion adapted to frictionally engage and slide along arcuate surface of curved portion 26 upon movement of toggle member between the release and engage position to permit the toggle member to be positioned without further movement on its own either in the release position or the engage position. The adjacent surfaces of the frame 10 and lip 22 are shaped, e.g., with recess 24, to hold the edge portion of fabric 12 therebetween when the toggle member is in its engage position thereby to restrict the withdrawal of fabric 12.

The mop frame preferably is an elongate member formed of coextensive rigid backing plate 15 which may include resilient pad 16 fastened together at their interface by suitable means such as adhesive or mechanical devices.

Preferably, frame 10 is an elongate member which has spired ends and includes opposed sets of toggle assemblies 11 adjacent each of the ends as shown in FIG. 1. A preferred dust mop has associated with frame 10 a handle holder 13 which includes a suitable opening 14 for the insertion of an elongate handle (not shown). The preferred handle holder 13 is a frictional universal joint of the type described in assignee's U.S. Pat. No. 3,850,533.

A preferred mop frame in accordance with the present invention includes on toggle member a handle portion 21 extending parallel to the pivot axis 25 and projecting from the side of pivot arm 20 opposite lip portion 22. Handle portion 21 facilitates the movement of toggle member from its engage position to its release position. A preferred mop frame in accordance with the invention also includes on toggle member a terminal end portion 23 which projects past the edge of frame 10 when the toggle member is in the engage position thereby providing a contact surface **23*a*** which may protect the fabric to a certain degree against contact with rough obstructions such as the legs of furniture, corners and other obstructions typically found on the floor surfaces being cleaned.

The dust mop frame of the present invention is made of materials which provide resistance to the environment in which the mop is to be used, as well as moderate structural strength. Preferably, the backing plate 15, toggle assemblies 11 and frictional universal joint 13 are constructed of acrylonitrile butadiene-styrene copolymer, but may be of polyacetal, nylon, metal, etc. Pad 16 is preferably resilient and may be formed of solid rubber or of foam rubber.

The pivot axis may be formed of the same material as the frame, e.g., a plastic material such as acrylonitrile butadiene-styrene copolymer, or it may be formed of metal, e.g., steel or brass, while the rest of the frame is of a plastic material. Alternatively, opposed toggle assemblies may employ a common pivot axis. Additionally, while it has been indicated herein that the toggle assemblies are in opposed sets on either side of the top of the frame, this is not to imply that they must be in exact opposed relationship. The toggle assemblies in a set may be offset from one another as would be readily apparent to one skilled in the art.

Springs 27 are preferably made of spring steel or an equivalent and may be in the shape of a "U", as shown, or may be a coil spring fitted with an appropriate follower on the end which contacts the arcuate surface and fitted into a corresponding shaped cavity 28.

That portion of lip 22 which contacts the fabric surface may be smooth or it may have a roughened surface to facilitate holding the nonwoven fabric, e.g., as provided by a pebbly, knurled or toothed surface. If there is no depression, e.g., 24, in the top surface of back plate 15 adapted to receive the end of lip 22, the nonwoven fabric contacting surface of lip 22 should be roughened. Alternatively, the top of back plate surface contacted by lip 22 may include a boss or projection at the contact point and a corresponding depression in the portion of lip 22 which contacts the projection to facilitate holding the fabric.

Satisfactory results have been obtained when the holding force of the toggle assemblies with the toggle members in the engage position is in the range of 0.75 inch pound to 3 inch pound, preferably about 2 inch pounds. Satisfactory results have been obtained, with the toggle members in the release position, e.g., vertical to 20 degrees pass center, with a spring force on the arcuate surface in the range of about 5 to 10 pounds. With the toggle members in the engage position, satisfactory results have been obtained with a spring force on the eccentric arcuate surface in the range of 12 to 24 pounds.

What is claimed is:

1. A dust mop frame having opposite top and bottom surfaces and being adapted to receive dusting fabric with a central portion of said fabric extending across said bottom surface and opposite edge portions of said frame extending onto said top surface; and means for retaining the edge portions of said fabric on said top surface comprising a plurality of toggle assemblies, each of said toggle assemblies being disposed in opposed sets with at least one toggle assembly adjacent each of said edge portions, each toggle assembly comprising:

a toggle member having a pivot axis, an arm portion projecting generally radially from said axis, a lip portion spaced from said axis, projecting from one side of said arm portion and extending parallel to said axis, and a curved portion having an arcuate surface disposed around said pivot axis;

means mounting said toggle member on said frame for positionable pivotable movement around said axis between a release position with said lip spaced from the top surface of said frame to afford insertion of the edge portion of said dusting fabric therebetween, and an engage position with said lip pressing the edge portion of said dusting fabric therebetween against said top surface;

a spring mounted on said frame and having a portion adapted to frictionally engage and slide along said arcuate surface upon movement of said toggle member between said release and engage positions; and the adjacent surfaces of said frame and said lip being shaped to hold the edge portion of said fabric therebetween when said toggle member is in its engage position thereby to restrict the withdrawal of the fabric.

2. A dust mop frame according to claim 1 wherein said frame is an elongate member having spired ends and includes opposed sets of said toggle assemblies adjacent each of said ends.

3. A dust mop frame according to claim 1 wherein each of said toggle members further includes a handle portion extending parallel to said pivot axis and projecting from the side of said pivot arm opposite said lip portion and a terminal end portion projecting past the edge of said frame when said toggle member is in said engage position.

4. A dust mop frame according to claim 1 wherein said arcuate surface is disposed eccentrically around said pivot axis to provide a first portion of said arcuate surface spaced a first distance from said axis and a second portion spaced a second distance from said axis which is less than said first distance; and said spring portion bears to a greater extent against the first portion of said arcuate surface when said toggle member is in its engage position, and bears to a lesser extent against the second portion of said arcuate surface when said toggle members is in its release position.

5. A dust mop frame according to claim 1 wherein said frame has openings recessed from said top surface adapted to receive said lips when said toggle members are in their engage position.

6. A dust mop comprising the dust mop frame of claim 1 having fastened thereto a handle holder fitted with a handle.

7. The dust mop of claim 6 wherein said handle holder is a frictional universal joint.

8. A dust mop frame having opposite top and bottom surfaces and being adapted to receive a dusting fabric with a central portion of said fabric extending across said bottom surface and opposite edge portions of said frame extending onto said top surface; and means for retaining the edge portions of said fabric on said top surface comprising a plurality of toggle assemblies, each of said toggle assemblies being disposed in opposed sets with at least one toggle assembly adjacent each of said edge portions, each toggle assembly comprising:

a toggle member having a pivot axis, an arm portion projecting generally radially from said axis, a lip portion spaced from said axis projecting from one side of said arm portion and extending parallel to said axis, an eccentric portion having an arcuate surface disposed eccentrically around said pivot axis to provide a first portion of said arcuate surface spaced a first distance from said axis and a second portion spaced a second distance from said axis which is less than said first distance;

means mounting said toggle member on said frame for positionable pivotable movement around said axis between a release position with said lip spaced from the top surface of said frame to afford insertion of the edge portion of said dusting fabric therebetween, and an engage position with said lip pressing the edge portion of said dusting fabric therebetween against said top surface;

a spring mounted on said frame and having a portion adapted to frictionally engage and slide along said arcuate surface upon movement of said toggle member between said release and engage positions with said spring portion bearing to a greater extent against the first portion of said arcuate surface when said toggle member is in its engage position, and bearing to a lesser extent against the second portion of said arcuate surface when said toggle member is in its release position; and the adjacent surfaces of said frame and said lip being shaped to hold the edge portion of a said fabric therebetween when said toggle member is in its engage position thereby to restrict the withdrawal of the fabric.

* * * * *